US008667955B2

(12) United States Patent
Leufen et al.

(10) Patent No.: US 8,667,955 B2
(45) Date of Patent: Mar. 11, 2014

(54) HANDHELD WORK APPARATUS HAVING A CONTROL UNIT FOR OPERATING AN ELECTRIC LOAD

(75) Inventors: Heinrich Leufen, Schwaikheim (DE); Jörg Präger, Winnenden (DE); David Fallscheer, Filderstadt (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 0 days.

(21) Appl. No.: 13/451,723

(22) Filed: Apr. 20, 2012

(65) Prior Publication Data

US 2012/0266850 A1 Oct. 25, 2012

(30) Foreign Application Priority Data

Apr. 23, 2011 (DE) ..... 10 2011 018 517

(51) Int. Cl.
*F02G 5/00* (2006.01)

(52) U.S. Cl.
USPC ..... 123/546; 123/142.5 R; 219/201; 219/202

(58) Field of Classification Search
USPC ..... 123/142.5 R, 344, 406.55; 219/201, 219/202, 204, 238, 535
See application file for complete search history.

(56) References Cited

U.S. PATENT DOCUMENTS

| | | | | |
|---|---|---|---|---|
| 6,232,672 | B1 | 5/2001 | Leufen et al. | |
| 6,968,908 | B2 * | 11/2005 | Tokunaga et al. | 173/181 |
| 7,816,796 | B2 | 10/2010 | Leufen et al. | |
| 7,882,900 | B2 * | 2/2011 | Borinato et al. | 173/176 |
| 2006/0019578 | A1 * | 1/2006 | Yamane et al. | 451/8 |
| 2008/0042643 | A1 * | 2/2008 | Maier et al. | 324/166 |
| 2008/0053407 | A1 * | 3/2008 | Maier et al. | 123/406.58 |
| 2010/0065295 | A1 * | 3/2010 | Aradachi et al. | 173/217 |

FOREIGN PATENT DOCUMENTS

WO WO 88/04072 A1 6/1988

* cited by examiner

*Primary Examiner* — Noah Kamen
*Assistant Examiner* — Long T Tran
(74) *Attorney, Agent, or Firm* — Walter Ottesen P.A.

(57) ABSTRACT

A handheld work apparatus has a drive motor which drives a work tool and a generator. The work apparatus has a first electrical load and a connectable second electrical load. The generator provides the electrical power for the simultaneous operation of the two loads. The work apparatus has a control unit for controlling the power supplied to the first electrical load. In order to supply approximately the same power independent of voltage fluctuations, a voltage monitoring circuit is provided which, in a first operating state, sets a first signal sequence for operating the first load and, in a second operating state, sets a different second signal sequence for operating the first load. The mean power of the first signal sequence and that of the other second signal sequence are approximately equal.

10 Claims, 3 Drawing Sheets

HANDHELD WORK APPARATUS HAVING A CONTROL UNIT FOR OPERATING AN ELECTRIC LOAD

CROSS REFERENCE TO RELATED APPLICATION

This application claims priority of German patent application no. 10 2011 018 517.8, filed Apr. 23, 2011, the entire content of which is incorporated herein by reference.

FIELD OF THE INVENTION

The invention relates to a handheld work apparatus having a drive motor which drives a work tool and a generator.

BACKGROUND OF THE INVENTION

U.S. Pat. No. 6,232,672 discloses a handheld work apparatus whose drive motor drives a generator. The generator supplies the power for operating a first electrical load such as a heater unit. The generator power generated varies in dependence on the rotational speed. At low rotational speeds only small amounts of power are available, at high rotational speeds, however, large amounts of power are available. The heating element here is configured so that a sufficient heating can he achieved at high rotational speeds, in order to, for example in the case of a carburetor heater, avoid the freezing of atmospheric moisture from the surroundings on the housing of the carburetor. Thereby it must be ensured that no overheating of the carburetor takes place because an overheating in the case of a carburetor heater can lead to the formation of vapor bubbles in the fuel and thus lead to an unstable operating performance of the combustion engine.

For controlling the heating power of a carburetor heater, it is suggested according to U.S. Pat. No. 7,816,796 to regulate the heating power of a heater unit in dependence on the rotational speed of the combustion engine. For this, a control unit is provided which controls the supplied heating energy in dependence on the rotational speed of the combustion engine.

If a carburetor heater is optimally configured with such a control unit, a disruption-free preparation of the mixture and thus a secure operation of the combustion engine can be ensured even at low ambient temperatures.

If further heater units are switched on in addition to the carburetor heater, for example handle heaters, the voltage at the carburetor heater drops because the generator can only provide limited electrical power. The drop in the voltage at the carburetor heater can result in a temperature drop.

SUMMARY OF THE INVENTION

It is an object of the invention to improve a handheld work apparatus of the type described above such that, with little complexity, a first electrical load is supplied with an approximately constant electrical power independent of whether further electrical loads are turned on or off.

The handheld work apparatus of the invention includes: a work tool; a generator; a drive motor configured to drive the work tool and the generator; a first electrical load; a second connectable electrical load; the generator being configured to supply power for simultaneous operation of the first and the second electrical loads; a control unit configured to control the amount of power supplied to the first electrical load; the control unit having a voltage monitoring circuit configured to set a first signal sequence for a first operating state I and to set a different, second signal sequence for a second operating state II; and, the first signal sequence and the second signal sequence having approximately the same mean power.

The voltage monitoring circuit of the control unit monitors a voltage which changes in dependence on the turned-on or turned-off electrical loads. In a first operating state of the voltage monitoring circuit a first signal sequence is set for the operation of the first load and in the second operating state a different, second signal sequence is provided for the operation of the first load. The signal sequences themselves are different, wherein, for example, the second signal sequence can, for example, have a lower amplitude but a higher frequency. It is provided that independent of the configuration of the signal sequence the mean power of the first signal sequence and the mean power of the second signal sequence are approximately the same. Thus, it is ensured that when there is a drop in voltage at the first load there is a switch to a signal sequence which compensates for the drop in power resulting from the drop in voltage. Thus, even when there is a drop in voltage, the first electrical load is operated with essentially the same electrical power as is the case at a higher voltage which has not dropped.

The voltage monitoring circuit is configured in a simple manner such that a load-dependent voltage is detected and below a predetermined voltage threshold value the control unit is operated in a second operating state, Whereas above the voltage threshold value it switches to the first operating state. The voltage monitoring circuit can also cause a switch of the control unit into the second operating state at a low generator voltage, so that even at low rotational speeds sufficiently high power is also provided to the electrical load. The drop in voltage can be caused by the switching on of further electrical loads as well as through a drop in the rotational speed of the combustion engine.

For providing essentially constant power to a heater unit in a work apparatus having a combustion engine, the generator voltage is exclusively monitored directly or indirectly, in order to, in dependence upon fluctuations of the monitored voltage, switch the control unit from a first signal sequence to a second signal sequence, wherein the signal sequences are different but supply essentially the same electrical power.

In particular, the switching of the control unit from the first into the second operating state occurs when the second electrical load, which can be configured as a heater unit, is connected.

The signal sequences of the first and the second operating state of the control unit can be different from each other such that the second signal sequence has more signals than the first signal sequence in the same time unit, thus having a higher frequency. The voltage amplitude of the second signal sequence is thereby smaller than that in the first signal sequence. it can be expedient to configure the signal duration of the second signal sequence longer than that of a signal of the first signal sequence in order to compensate the drop in signal amplitude.

Preferably the first and the second electrical loads are heater units, whereby the first heater unit especially is a carburetor heater while the second heater unit can be a handle heater.

The loads are expediently directly connected to an alternating voltage of the generator so that the power supplied to the load can be set with a half-wave circuit. Alternatively, in the case of an alternating voltage, the power supplied to the load can also be set with a phase-gating control means.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
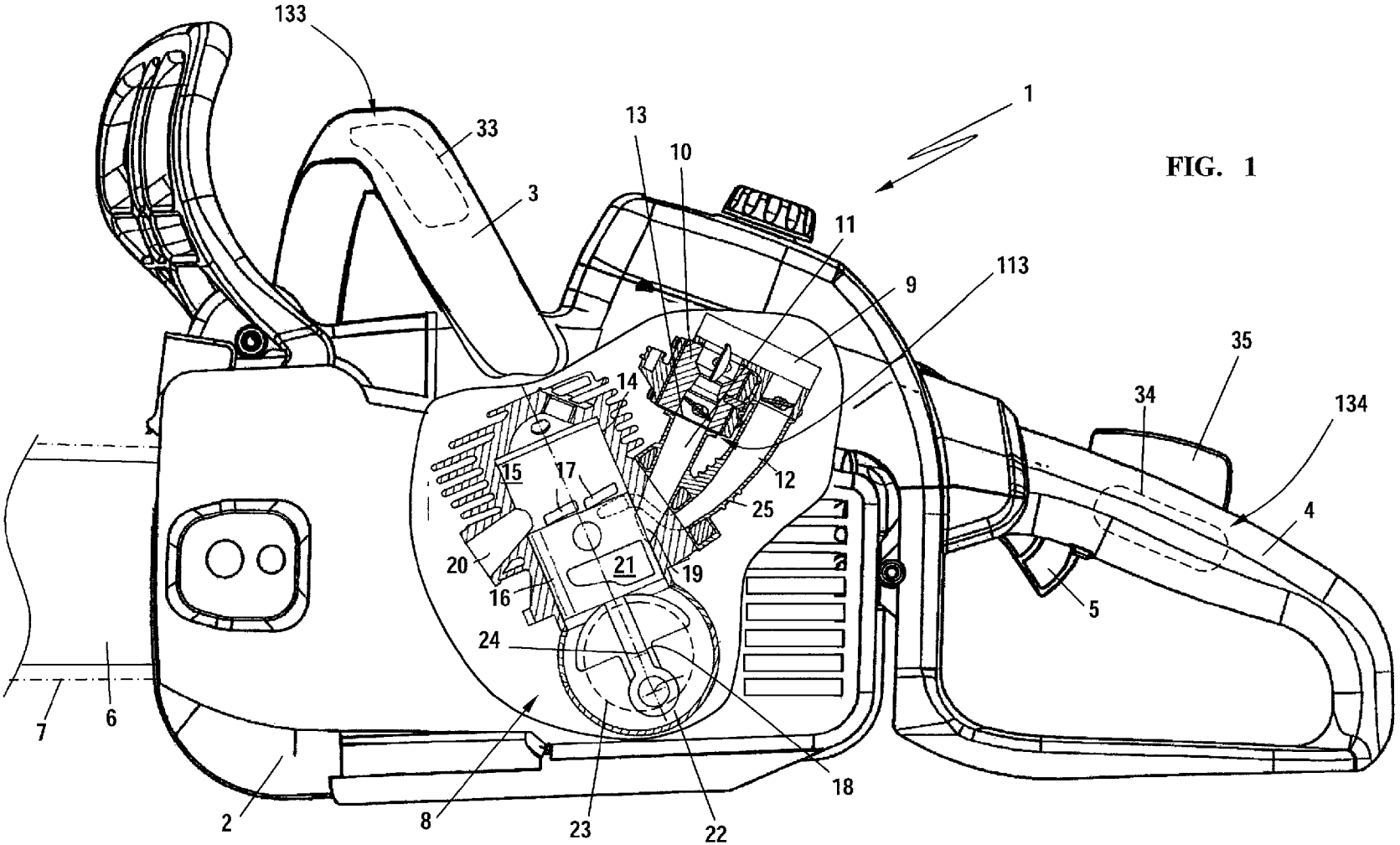
FIG. 1 is a schematic side view of a handheld, portable work apparatus shown by the example of a chain saw.

The control unit according to the invention for controlling the electrical power supplied to an electrical load is described as an example embodiment of the electrical power supplied to a heater unit. The heater unit is built into a work apparatus as is shown in FIG. 1. The handheld work apparatus 1 is a portable, handheld work apparatus which is described below by the example of a chain saw. The work apparatus can also be configured as a cut-off machine, a hedge trimmer, a brush-cutter, a blower apparatus or a similar work apparatus.

The portable, handheld work apparatus of FIG. 1 has a housing 2 in which a combustion engine 8 is arranged. A rear handle 4 is fixed on the housing 2 which is aligned in the longitudinal direction of the work apparatus 1. In the front, upper region of the housing 2, a tubular handle is arranged as a front handle 3 which extends over the top side of the housing 2 in an arch with a distance to the housing 2 and is essentially arranged transverse to the longitudinal direction of the work apparatus 1. A work tool 7, which is driven by the combustion engine 8, is provided on the front end of the housing 2 which lies opposite the rear handle 4. The work tool 7 is configured as a saw chain which is guided about the periphery of a guide bar 6 in the example embodiment shown. The guide bar 6 projects forwards from the front end of the housing 2 parallel to the longitudinal axis of the work apparatus 1. For operating the combustion engine 8, a throttle lever 5 is pivotally arranged in the rear handle 4 with which the rotational speed of the combustion engine configured as a two-stroke engine can be controlled. A throttle lever lock 35 mounted in the handle 4 is associated with the throttle lever 5.

In the shown example embodiment, the combustion engine 8 arranged in the housing 2 is configured as a two-stroke engine, especially as a one-cylinder two-stroke engine. The combustion engine 8 has a cylinder 14 in which a combustion chamber 15 is formed. The combustion chamber 15 is delimited by a piston 16. The piston 16 rotatably drives a crankshaft 18 which is rotatably mounted in a crankcase 22 about a rotational axis 24. In the region of the bottom dead center of the piston 16 shown in FIG. 1, the crankcase 22 and the combustion chamber 15 are interconnected via transfer channels 17. The combustion engine 8 further has an inlet 19 into the crankcase 22 for an air/fuel mixture as well as an outlet 20 via which exhaust gases are discharged from the combustion chamber 15. The combustion engine 8 via an intake channel 11 draws in the air/fuel mixture via a carburetor 10 ahead of which an air filter 9 is arranged. The combustion air required for the operation of the engine flows in via the air filter 9.

A supply channel 12, which opens in the cylinder 14 and in the region of the top dead center of the piston 16, communicates with the transfer channels 17 via a piston pocket 21 formed on the piston 16. The supply channel also opens at the air filter 9. The combustion engine 8 draws scavenging air into the transfer channels 17 via the supply channel 12. The intake channel 11 and the supply channel 12 are configured in a common component 25 via which the carburetor is connected to the cylinder 14. An electrical heating element 13 is arranged between the carburetor 10 and the stud-shaped component 25 as a first electrical load 27 which can be fixed on the carburetor 10 and serves to heat the carburetor. The electrical heating element 13 forms the first heater unit 113 in the work apparatus 1.

During operation, the combustion engine 8 draws the air/fuel mixture into the crankcase 22 via the intake channel 11, while essentially fuel-free combustion air flows into the transfer channels 17 via the supply channel 12. The air/fuel mixture is compressed in the crankcase 22 during the downward stroke of the piston 16 and is displaced into the combustion chamber 15 via the transfer channels 17 as soon as the transfer channels 17 are opened toward the combustion chamber 15 by the piston 16 moving toward the crankcase 22. The fuel-free combustion air pre-stored in the transfer channels 17 separates the fresh air/fuel mixture moving from the crankcase 22 into the combustion chamber 15 from the exhaust gases present in the combustion chamber 15 which are flushed out through the outlet 20. During the upward stroke of the piston 16, the freshly flowed-in air/fuel mixture is compressed in the combustion chamber 15 and is ignited by a spark plug, not shown, in the region of the top dead center of the piston 16. During the downward stroke of the piston 16, the outlet 20 is opened and the exhaust gases flow out of the combustion chamber 15, whereby they are pushed to the outlet by the scavenging air flowing in at the same time via the transfer channels 17.

For the operation of the combustion engine 8, a sufficient amount of fuel must be drawn in via the intake channel 11. At low temperatures, moisture from the ambient air can deposit in the carburetor 10 and freeze there. This can negatively affect the function of the carburetor 10. In order to avoid temperatures at the carburetor 10 which are too low, the first heater unit 113 with the heating element 13 is provided as the first electrical load 27. The heating element 13 is heated electrically and warms the carburetor 10 at low ambient temperatures.

At low temperatures, heating of the carburetor 10 is practical and also the handles 3 and 4 provided for guiding the work apparatus advantageously also have a heater unit 133 with a heating element 33 and a second heater unit 134 with a heating element 34. The handles 3 and 4 are to be heated via the heater units 133 and 134 when there is demand therefor. As a result, a person guiding the work apparatus 1 retains warm hands when working which not only serves for comfort but also assists a safe guiding of the work apparatus 1 at low temperatures. These second heating units (133, 134) form the second electrical load which can be switched on when there is demand The heater units 113, 133 and 134 are electrical loads (27, 37) as electrical heater units and are supplied with electrical power by a generator 23. The generator 23 is driven by the crankshaft of the combustion engine 8 and rotates in dependence upon the rotational speed (n) of the combustion engine. In the case of a direct driving of the generator, the rotational speed of the generator 23 corresponds to the rotational speed (n) of the combustion engine 8.

Figure 3:
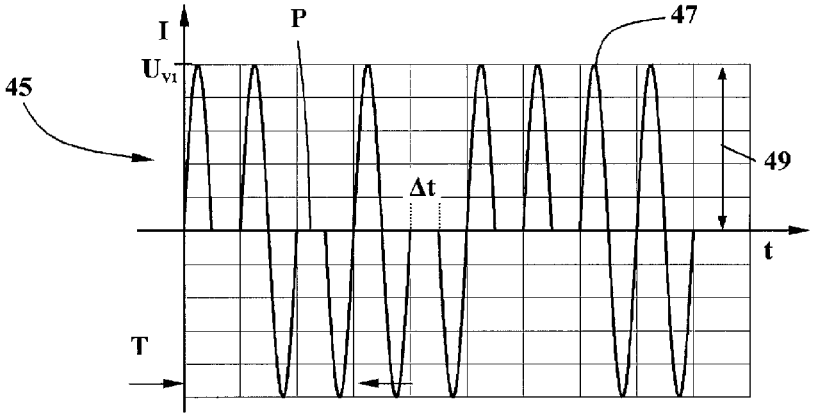
FIG. 3 is a schematic of the alternating voltage supplied to a first heater unit via a half-wave circuit in a first switch position of the control unit.

A schematic circuit diagram of the wiring of the generator 23 with the heating element 13 of the first heater unit 113 as a first electrical load 27 and the respective heating elements (33, 34) of the second heater units (133, 134) are shown as second electrical loads 37 in FIG. 3.

Figure 2:
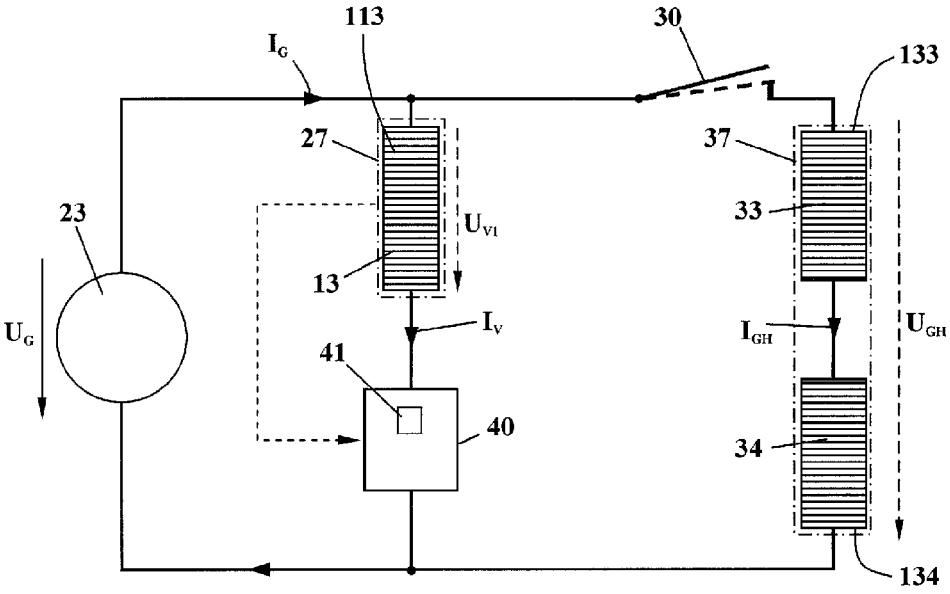
FIG. 2 is a schematic circuit diagram for the energy supply of heater units having a control unit.

As FIG. 2 shows, the second heater unit 133, that is the second electrical load 37, can be switched on or off via a switch 30. The first electrical load 27, that is the first heater unit 113, can be permanently connected to the terminals of the generator 23; expediently, a bimetal switch can be provided, which interrupts the electrical connection between the generator connections and the first heater unit 113 above a threshold temperature, such as, for example, 20° C. Advantageously, an NTC thermosensor is used, which is integrated into a controller integrated in the control unit 40 in such a manner that a simple temperature control of the first heater unit 113 is achieved. In this way, the temperature of the first heater unit 113 is simple to monitor and at the same time can be securely set via the controller.

If the first electrical load 27, that is the heater unit 113 of the carburetor heater, is turned on then the full generator voltage $U_{G1}$ is applied to the carburetor heater. In the example embodiment, a control unit 40 is connected in series with the heating element 13 of the first heater unit 113, so that the heating current $I_V$ flows through the heating element 13 as well as the control unit 40.

The control unit 40 includes a voltage monitoring circuit 41 which, in the shown example embodiment, is integrated into the control unit 40. Expediently, the electrical power supplied to the first load 27 is set via the control unit 40. The alternating voltage $U_G$ generated by the generator 23 is, in a special embodiment of the invention, applied to the first electrical load 27 via a half-wave circuit or a phase-gating control means integrated in the control unit 40, whereby, for example, a temperature feedback by the heating element 13 of the first electrical load 27 to the control unit 40 can be expedient, as is indicated by the dashed line in FIG. 2.

The total electrical power of the generator 23 is configured in such a manner that the first electrical load 27, that is the first heater unit 113 of the carburetor heater, as well as the second electrical load, that is the second heater unit 133 as a handle heater and/or the further heater unit 134 as a second handle heater, can be supplied with a sufficient amount of electrical power. If the handle heaters are turned off with the switch 30 open, the total sum of electrical power of the generator 23 is supplied to the first electrical load 27, the carburetor heater. The heating element 13 of the carburetor heater could overheat. For this reason, it is provided that the control unit 40 is configured in such a manner that, by influencing the generator voltage applied, the flowing current $I_V$ can be limited to a mean current and thus to a mean power which corresponds to the desired temperature of the heating element 13.

The generator voltage $U_{V1}$ which is applied to the first electrical load 27 via a half-wave circuit is shown in FIG. 3. The alternating voltage of the generator 23 is blocked for one or more half-waves 47 so that pauses P having the duration Δt result in the alternating voltage. During a pause, no current $I_V$ flows so that the current generator voltage is applied to the control unit 40 during the pause duration Δt. The voltage monitoring circuit 41 evaluates the generator voltage detected during a pause P and switches to the first signal sequence 45 or to the second signal sequence 46 (FIG. 4) in dependence upon the value of the generator voltage. The first signal sequence 45 is set in such a manner that, even at an extremely high rotational speed (n) of the combustion engine 8 and the then outputted power of the generator 23, an overheating of the heating element 13 and thus inappropriately high temperatures at the carburetor 10 are reliably avoided.

Figure 4:
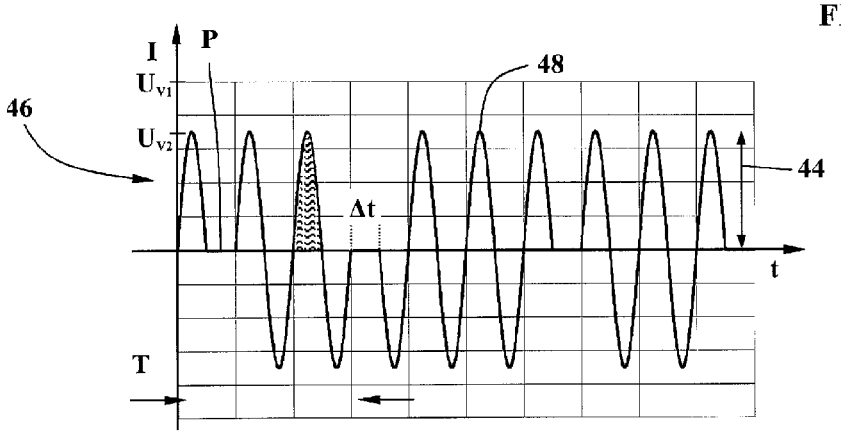
FIG. 4 is a schematic of the alternating voltage supplied via a half-wave circuit according to FIG. 3 in a second switch position of the control unit.

If the switch 30 is closed, the generator voltage $U_G$ is applied to the first electrical load 27, the first heater unit 113, as well as to the second electrical load 37, the second heater units (133, 134). The generator current $I_G$ divides into the current $I_V$ through the carburetor heater and the current $I_{GH}$ through the handle heaters. With the switching on of the switch 30, a higher loading of the generator results at the same time, this being accompanied by a drop in the generator voltage. The voltage monitoring circuit 41 of the control unit 40 detects this voltage drop in a pause P, because, during the pause P, the generator voltage as a result of the permanent electrical loading through the second load (handle heater) is lower than without the load resulting from the handle heater. If the lower generator voltage is detected during a pause, the voltage monitoring circuit 41 switches the control unit 40 out of a first operating state I with a first signal sequence 45 (FIG. 3) into a second operating state II with a second signal sequence 46 (FIG. 4). This switching of the control unit 40 from the first operating state into the second operating state thus occurs with the connection of the second electrical load, namely the heater units 133 and 134, the handle heaters.

The second signal sequence 46 has more half-waves 48 than the first signal sequence 45 during an identical time period T. At the same time, the amplitude 44 of a Signal 48 of the signal sequence 46 is less with a value $U_{v\,2}$As a result of the increased number of half-waves 48 in the same time unit T, the drop in generator voltage, which results from the load of the second load 37,is compensated for in such a manner that approximately the same electrical energy is supplied to the heating element 13 of the first heater unit 113 as within the time unit T during the first operating state and the first signal sequence 45. The pauses P between two signals 48 of the signal sequence 46 correspond to the pauses P between the signals 47 of the first signal sequence 45, however, less pauses occur over time.

In order to equalize the generator voltage which is reduced as a result of the load of the second electrical load 37, a phase-gating control means, whose function is described with reference to FIGS. 5 and 6, can also be used.

Figure 5:
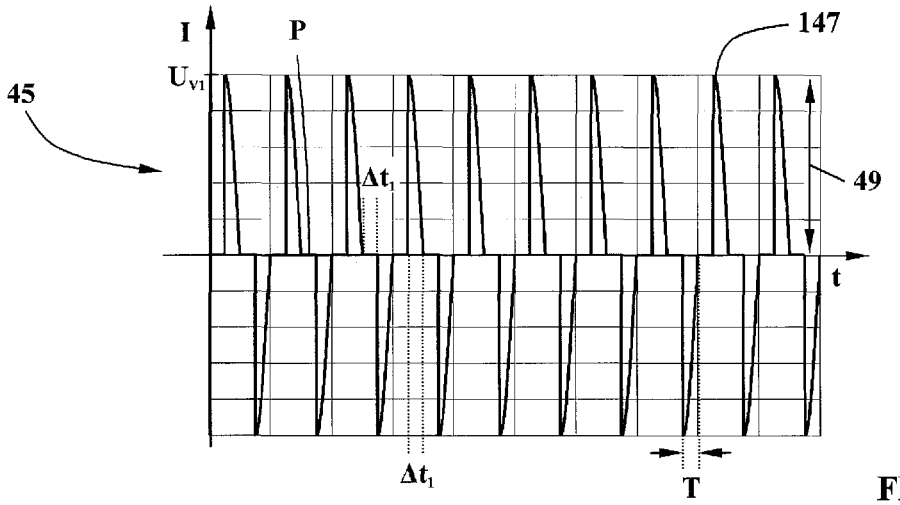
FIG. 5 is a schematic of the alternating voltage supplied to a first heater unit via a phase-gating control means in a first switch position of the control unit.

As FIG. 5 shows, the generator voltage is influenced in such a manner that, after a zero-crossing, a variable blocking time can be set, that is, settable pauses P having the duration $\Delta t_1$ result between two half-waves 147. Each half-wave is applied to the electrical load, however, the signal duration T of a half-wave 147 can be set. The pauses P and thus the signal duration T of a half-wave of the signal sequence 45 in FIG. 5 is configured in such a manner that an overheating of the heating element 13 and thus impermissibly high temperatures at the carburetor 10 are reliably avoided even at the highest rotational speed (n) of the combustion engine 8 and the then outputted power of the generator 23.

Figure 6:
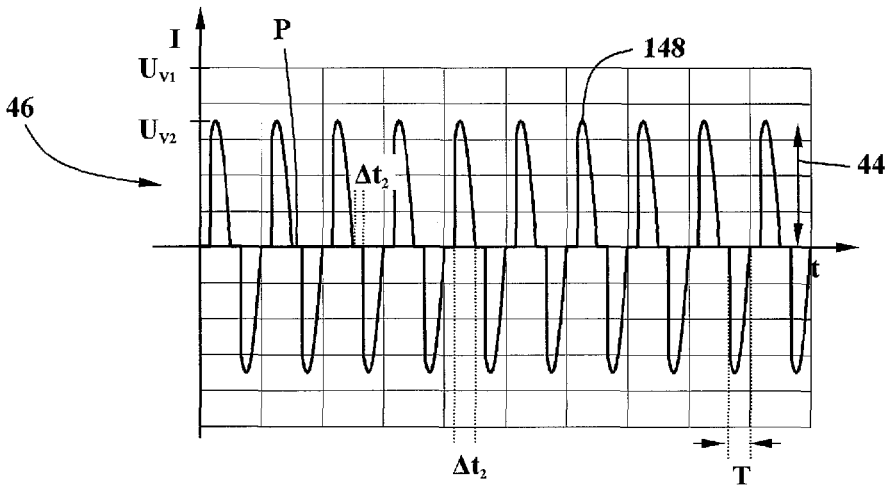
FIG. 6 is a schematic of the alternating voltage supplied via a phase-gating control means according to FIG. 5 in a second switch position of the control unit; and, FIG. 7 is a schematic of the switch state of the operating positions in dependence upon a monitored voltage.

If the second electrical load 37 is connected by closing the switch 30, a drop in the generator voltage results because of the electrical load, which is detected by the voltage monitoring circuit 41 during a pause P and leads to a switch to the second signal sequence 46 of FIG.6. The signal amplitude 44 of the half-waves 148 of the signal sequence 46 is lower than the signal level 49 of the first signal sequence 45, this being caused by the increased electrical load on the generator 23. In order to supply the same amount of electrical power to the first electrical load during the same time unit, the pause duration $\Delta t_2$ is reduced by the phase-gating control means so that the signal duration T is increased. Thus, despite the drop in generator voltage, the same amount of electrical power is supplied to the first electrical load 27 as prior to the switching on of the second electrical load 37.

Figure 7:
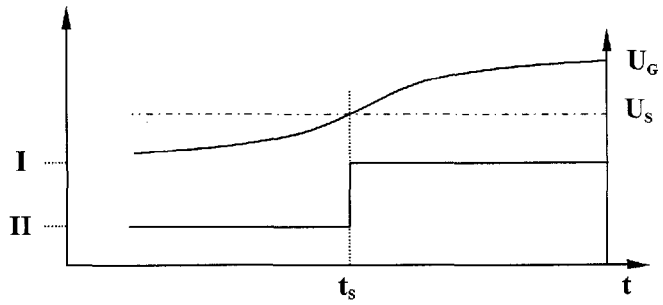

At an arbitrary operating rotational speed (n) of the combustion engine 8, the voltage monitoring circuit 41 has the task of determining the switching on of the second electrical load 37 in the form of the second heater units (133, 134), that is the handle heater. This is achieved by monitoring the current generator voltage $U_G$ during the pauses P of the affected signal sequence 45 or 46. Below a predetermined voltage threshold $U_S$ (FIG. 7), the control unit 40 is operated in the operating state II (FIG. 5); if the monitored voltage U exceeds the threshold value $U_S$ this is detected by the voltage monitoring circuit 41 and the control unit 40 is switched back into the first operating state I. In the first operating state I, a signal sequence 45 with a predetermined mean electrical power is set, which, for example, ensures sufficient heating of the carburetor without overheating of the same. If the generator voltage drops as a result of an additional electrical loading, that is, the mean power of the first signal sequence 45 drops as a result of a changed generator voltage, the control unit switches to a second predetermined signal sequence 46 which, in consideration of the lower generator voltage, sets approximately the same mean electrical power as the first signal sequence 45. Independent of the switching on or switching off of the switch 30, the first heater 113, that is the carburetor heater, receives essentially the same electrical power which ensures essentially the same heating up of the carburetor 10 to a predetermined temperature.

It can be advantageous to configure the circuit arrangement in such a manner that the switching from a first signal sequence 45 to a second signal sequence 46 with approximately the same mean electrical power is also done in dependence upon the rotational speed of the generator. If the rotational speed is low, that is the generator voltage is low, the first electrical load is operated with a second signal sequence 46; if the rotational speed and thus the generator voltage increases, then there is a switch to the first signal sequence 45.

It is understood that the foregoing description is that of the preferred embodiments of the invention and that various changes and modifications may be made thereto without departing from the spirit and scope of the invention as defined in the appended claims.

What is claimed is:

1. A handheld work apparatus comprising:

a work tool;

a generator;

a combustion engine configured to drive said work tool and said generator;

a first electrical load;

a second connectable electrical load;

said generator being configured to supply power for simultaneous operation of said first and said second electrical loads;

a control unit configured to control the amount of electrical power supplied to said first electrical load;

said control unit having a voltage monitoring circuit for monitoring the generator voltage ($U_G$) of said generator;

said voltage monitoring circuit being configured to switch said control unit into a first operating state (I) when said generator voltage ($U_G$) exceeds a pregiven voltage threshold value ($U_s$) wherein a first signal sequence is supplied to said first electrical load for operating said first electrical load;

said voltage monitoring circuit being further configured to switch said control unit into a second state (II) when said generator voltage ($U_G$) drops below said voltage threshold value ($U_S$) wherein a second signal sequence is supplied to said first electrical load for operating said first electrical load with said second signal sequence being different from said first signal sequence; and, said first signal sequence and said second signal sequence having approximately the same mean power.

2. The work apparatus of claim 1, wherein said control unit switches from said first operating state (I) into said second operating state (II) when said second electrical load is connected.

3. The work apparatus of claim 1, wherein said second signal sequence has a lower signal amplitude than said first signal sequence.

4. The work apparatus of claim 1, wherein said second signal sequence has a signal width ($\Delta t_2$) of a signal which is greater than a signal width ($\Delta t_1$) of a signal of said first signal sequence.

5. The work apparatus of claim 1, wherein at least one of said first and said second electrical loads is a heater unit.

6. The work apparatus of claim 5, wherein said combustion engine has a carburetor and said first electrical load is a carburetor heater.

7. The work apparatus of claim 5 further comprising a handle for guiding said work apparatus; and, said second electrical load being a handle heater.

8. The work apparatus of claim 1, wherein said generator outputs an alternating voltage and said first and said second electrical loads are connected to said alternating voltage of said generator.

9. The work apparatus of claim 1, wherein the power supplied to said first and second electrical loads can be set by a half-wave circuit.

10. The work apparatus of claim 1, wherein the power supplied to said first and second electrical loads can be set by a phase-angle control.

* * * * *

UNITED STATES PATENT AND TRADEMARK OFFICE

CERTIFICATE OF CORRECTION

PATENT NO. : 8,667,955 B2
APPLICATION NO. : 13/451723
DATED : March 11, 2014
INVENTOR(S) : Leufen et al.

It is certified that error appears in the above-identified patent and that said Letters Patent is hereby corrected as shown below:

In the Specification

Column 1:
Line 27: delete "he" and insert -- be -- therefor.

Column 2:
Line 24: delete "Whereas" and insert -- whereas -- therefor.
Line 50: delete "it" and insert -- It -- therefor.
Line 50: insert -- of a signal -- after "duration".

Column 6:
Line 27: delete "Signal" and insert -- signal -- therefor.
Line 28: delete "$U_{v2}$As" and insert -- $U_{v2}$. As -- therefor.

Column 7:
Line 25: insert -- unit -- after "heater".

Signed and Sealed this
Sixteenth Day of September, 2014

Michelle K. Lee

Michelle K. Lee
*Deputy Director of the United States Patent and Trademark Office*